US007475687B2

(12) United States Patent
Merten

(10) Patent No.: US 7,475,687 B2
(45) Date of Patent: Jan. 13, 2009

(54) NAILCARE DEVICE WITH A DISCOID GRINDING BODY DRIVEN BY AN ELECTRIC MOTOR

(76) Inventor: Guenter Merten, Leitlestrasse 9, D-82467 Garmisch-Partenkirchen (DE)

( * ) Notice: Subject to any disclaimer, the term of this patent is extended or adjusted under 35 U.S.C. 154(b) by 582 days.

(21) Appl. No.: 10/561,982

(22) PCT Filed: Jul. 6, 2004

(86) PCT No.: PCT/EP2004/007343

§ 371 (c)(1),
(2), (4) Date: Dec. 21, 2005

(87) PCT Pub. No.: WO2005/018373

PCT Pub. Date: Mar. 3, 2005

(65) Prior Publication Data

US 2006/0180170 A1 Aug. 17, 2006

(30) Foreign Application Priority Data

Aug. 16, 2003 (DE) ..... 103 37 611

(51) Int. Cl.
*A45D 29/04* (2006.01)
*A45D 29/05* (2006.01)

(52) U.S. Cl. ..... 132/75.8; 132/73.6

(58) Field of Classification Search ..... 132/75.8, 132/73.6, 73.5, 73, 75.6, 76.4; 451/355, 451/344

See application file for complete search history.

(56) References Cited

U.S. PATENT DOCUMENTS 1,604,720 A * 10/1926 Pflantzer ..... 132/75.8

(Continued)

FOREIGN PATENT DOCUMENTS

DE 298 16 824 12/1998

*Primary Examiner*—Robyn Doan
(74) *Attorney, Agent, or Firm*—Michael J. Striker

(57) ABSTRACT

The invention relates to a nailcare device, comprising a housing (1) and a discoid grinding body (4), driven by an electric motor, sitting on a driveshaft (10), connected to an electric motor (6). The essentially discoid grinding body (4) is arranged in the upper part of the device housing (1), beneath a cover or plate (3), parallel to the upper side (4*a*) of the grinding body (4), fixed to the housing (1) of the device in an easily detachable manner and with at least two slots (3*a*) for the fingernail of the user as close as possible to the grinding body (4) at differing radial separations from the driveshaft (10). The cover or plate (3) can be funnel- or cone-shaped with relation to the grinding body (4), such that the axial separation between the upper side (4*a*) of the discoid grinding body (4) and the slots (3*a*), arranged at various radial separations from the driveshaft (10), increases or decreases with increasing separation from the driveshaft (10). The above presents the advantage that, as a result of the varying separation of the slots (3*a*) from the upper side (4*a*) of the grinding body (4) and the various forms of the slots (3*a*), not only crowned fingernails but also those of the right and left hands can be treated one after the other without a change of template. The device can also be placed on a level surface for carrying out the nail treatment and doesn't need to be guided by the other hand, permitting a single-handed treatment of the nails and thus significantly facilitates the use for nailcare by handicapped people with only one hand and people requiring assistance.

27 Claims, 4 Drawing Sheets

U.S. PATENT DOCUMENTS 1,951,305 A 3/1934 Hoffberger
3,311,117 A * 3/1967 Thompson ..... 132/73.6
4,117,854 A 10/1978 Rosenbloom
4,753,253 A * 6/1988 Hutson ..... 132/73.6
5,123,430 A * 6/1992 Davidovitz ..... 132/75.8
6,799,579 B2 * 10/2004 Joseph ..... 132/73.6

* cited by examiner

Fig. 4
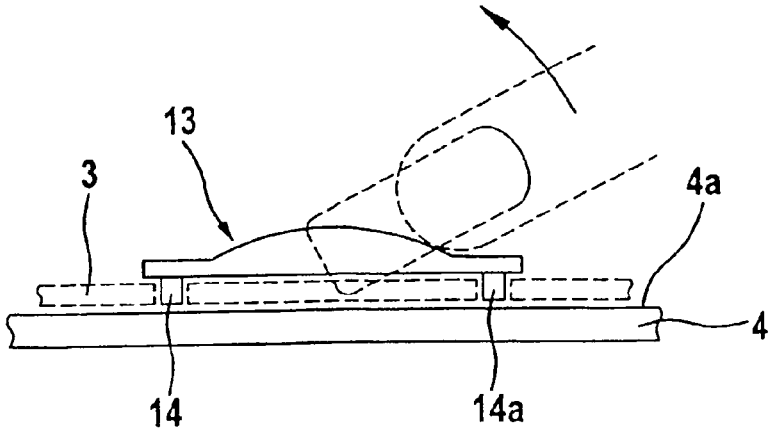
Fig. 5
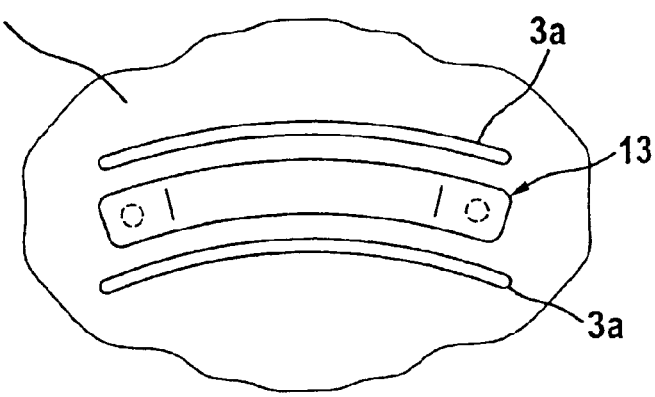
Fig. 6
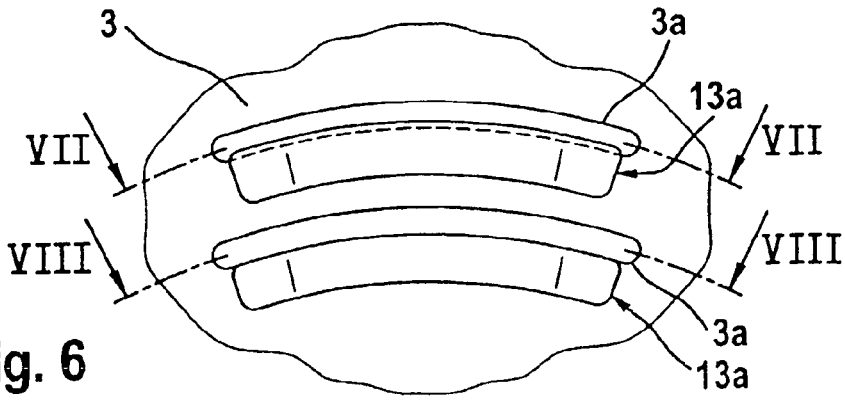
Fig. 7
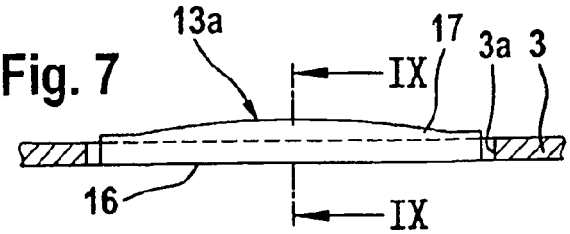
Fig. 8
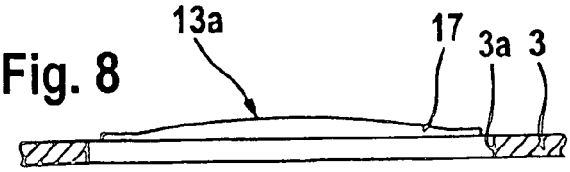
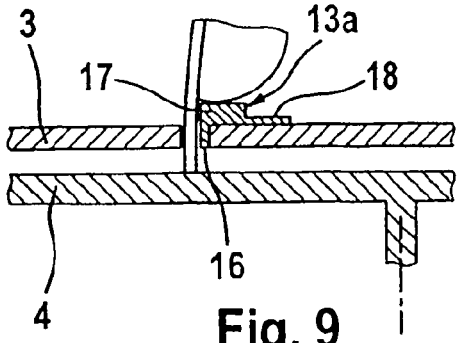
Fig. 9

Fig. 12
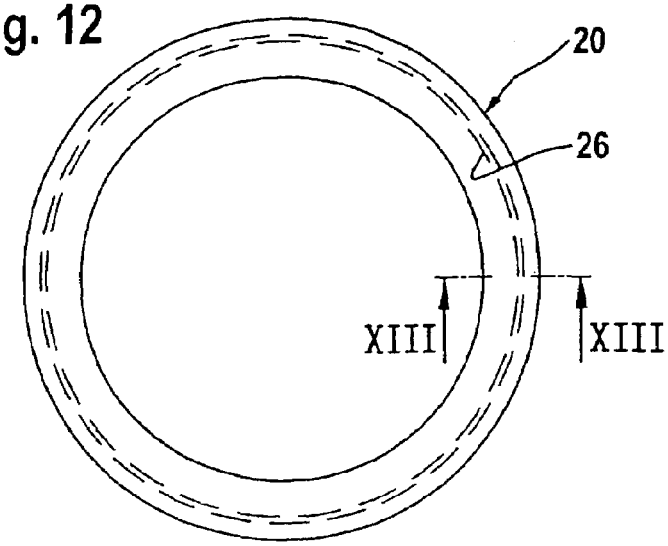
Fig. 13
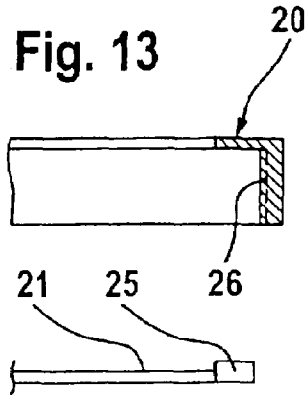
Fig. 14
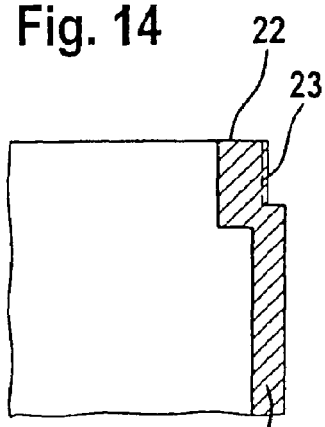
Fig. 15
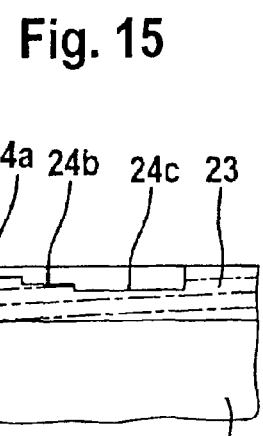
Fig. 11
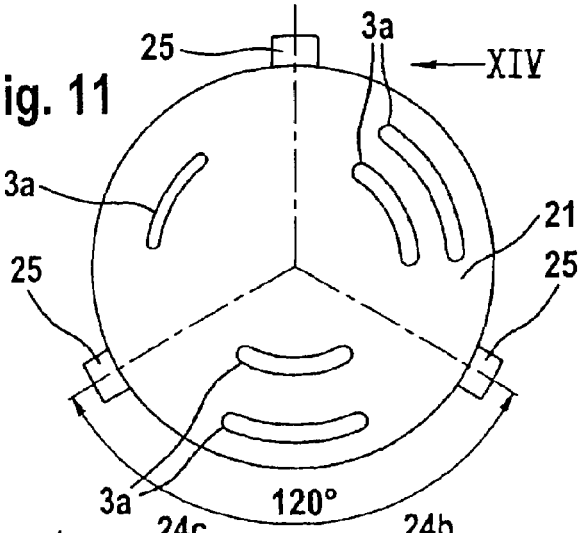
Fig. 16
Fig. 10
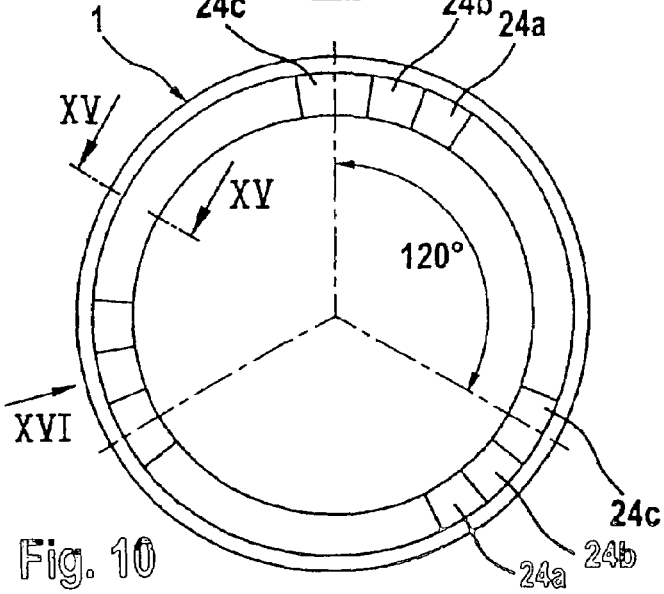
Fig. 17
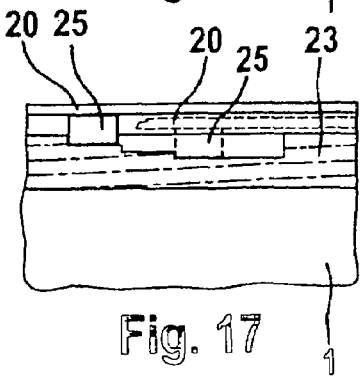

NAILCARE DEVICE WITH A DISCOID GRINDING BODY DRIVEN BY AN ELECTRIC MOTOR

The invention relates to a nailcare device with a housing and a discoid grinding body, driven by an electric motor, as generically defined by the preamble to claim 1.

Devices are known that have an encapsulated electric motor and are battery-operated or plugged in and whose drive shaft can be equipped with various filing, grinding and polishing heads. These devices must be held with one hand and guided freehand with a grinding body along the fingernail of the other hand; hence the shaping of the fingernail is highly unreliable, because it depends definitively on the user keeping her hand still.

From German Utility Model DE 298 16 824 U1, a nailcare device driven by an electric motor is known that is intended for shortening and/or finely filing toenails and fingernails, having a housing and variously shaped filing tools which are located on the housing, each under a covering in the form of a cap, which is releasably joined to the housing by a thread or a bayonet mount. In one embodiment of this nailcare device, a frustoconically embodied rotating filing tool is located on the upper end of the housing, through a cap having a plurality of slots, each located in dish-shaped spacers, for selectively shortening or finely filing a fingernail or toenail. The dish-shaped spacers with the slots are distributed over the circumference of the frustoconical filing tool and are each at a different spacing from the tool, so that the length of the fingernail can be defined by the selection of one of the spacers. The housing of this nailcare device is designed in tubular form, and the cap for the covering of the frustoconical filing tool is embodied as tapering to a point at the top, corresponding to the shape of the filing tool, with the consequence that the dish-shaped spacers distributed over the cap, with the slots located in them, can have only a comparatively short length longitudinally of the associated slot. However, as a consequence, only relatively long, narrow fingernails can be manicured with even some satisfaction using the device, while for wider fingernails, the comparatively short slots are not long enough to bring the fingernail even sideways up to the working surface of the filing tool. This device, too, must be held and controlled with one hand in order to manicure the nails of the other hand. Such devices are therefore only of limited use.

The object of the invention is to improve a nailcare device or manicure device, of the type defined at the outset, in such a way that by simply introducing the fingernail from above into variously shaped slots, adapted to the contours of the fingernails and located at various radial spacings from the drive shaft on the upper covering of the grinding body, the desired length and contour of the fingernails can be created and shaped in a simple way by pivoting the fingertip with the fingernail in the slot that fits it.

This object is attained, based on a nailcare device as generically defined by the preamble to claim 1, by the invention in that the grinding body is embodied as essentially discoid; and that the covering, above the grinding body, is shaped such that the axial spacing between the top of the discoid grinding body and the slots, located on the covering at different radial spacings from the drive shaft, increases or decreases with increasing spacing from the drive shaft.

Especially advantageous refinements of the invention are contained in the dependent claims.

The invention has the advantage that a plurality of slots on the covering or plate can be distributed above the grinding body at a variable radial spacing from the drive shaft and above the entire surface of the covering at variable spacings from the substantially discoid grinding body, side by side, such that because of the different shape of the slots, the arched fingernails of both the right and the left hands can be manicured in succession, with precisely defined, different nail lengths, without changing templates. The various kinds of slots can be distributed over the entire covering of the grinding body, rotating or oscillating just below the covering, at different spacings radially to the drive shaft such that as a result of the manicuring operations in filing the fingernails, the file-like surface of the grinding body is occupied at different slots, each along different circles on the surface and thus as uniformly as possible. This not only improves the filing operation but also contributes to simple and especially convenient manipulation of the device and a suitably long service life.

The covering can be dished in a slightly funnel-like fashion or slightly conically arched, so that the axial spacing of the slots, distributed radially outward over the covering, from the grinding body decreases or increases accordingly. Moreover, to achieve different axial spacings of the slots from the surface of the grinding body, the grinding body may be shaped slightly conically; conversely, indenting of the grinding body as a rule must be averted.

Another advantageous characteristic of the invention is that, because of the location of the slots above the grinding body, for nailcare, the device can be placed on a level surface and does not need to be guided or held with the other hand, as is the case in the known devices. The device therefore makes one-handed manicuring of the nails possible, making it decisively easier even for handicapped persons with only one hand, or for persons who need care, to care for their nails on their own. This is assured by the overall compact design and the easy manipulation of the device. The bottom of the device may be embodied with a slip-proof base of rubber or plastic, or as a suction cup.

It is also especially advantageous if the slots are different in shape, width, and/or length. Thus a plurality of slots, preferably in groups of two to four slots each, of the same and/or partly different shape, width, and/or length may be located on the covering or plate at mutually offset radial spacings from the drive shaft, side by side above the grinding body; an especially preferred embodiment may be designed such that a plurality of slots of the same and/or partly different shape, width, and/or length are located in groups of two to four, preferably three, slots, parallel or arched in curved form, each at equal radial spacings from one another, and the individual groups of slots are distributed, each in approximately equal angular spacings of preferably approximately 90° or 120°, over the surface of the covering or plate.

The grinding body is secured releasably and interchangeably to the drive shaft, and is spring-loaded relative to the housing body and the covering or plate, preferably in the direction of the drive shaft, in such a way that it can escape an excessively strong nail pressure. This has the advantage that the spacing between the grinding body and the finger rest in manicuring the fingernails is not fixed but instead, because of the resilient support of the grinding body, can adapt continuously and automatically to the progress of filing.

Not only the surface of the discoid grinding body but also its peripheral edge can advantageously be used for nailcare, if at least one additional nail manicuring option exists on the lateral circumference of the device, next to the grinding body, with a rest for the fingertip and with a slot, parallel to the grinding body, for the fingernail. This can also be advantageous if the applicable slot has a different contour from the slot on the top of the covering or plate, so that the option of manicuring from the side can be utilized for various specific shapes of fingernail.

It is also advantageous that the electric motor of the device is encapsulated against penetrating fingernail dust in a simple way next to the rotating or oscillating grinding body. This is expediently done in that the electric motor is surrounded by a dust guard sheet between the drive shaft and the side wall of the housing.

Finally, the manicuring capabilities of the device can be further expanded by providing that the slots on the covering or plate can be assigned fingernail templates, in the form of interchangeable, differently shaped ramps for the fingertip to roll on, for special shapes of nails. This can be done in an especially simple way in that the ramps, with preferably terminal tabs, are insertable into openings or bores between slots, located side by side, on the covering or plate. The ramps are expediently profiled such that the user, solely by rolling the fingertip on the ramp, can give the desired contour to the fingernail that comes into contact with the grinding body. However, the fingernail template can also be secured releasably to the covering or plate by means of a contact adhesive. For precisely securing these fingernail templates, at least some of the slots on the covering or plate may have a radial width such that by means of a rib peripherally engaging the slot, and by means of a profiled ramp oriented upward from the rib, fingernail templates adapted to the course of the slot come into contact with a self-adhesive securing strip, parallel to the top of the plate and oriented to the rear, directly beside the slot.

In an especially advantageous refinement of the invention, it is also provided that the covering or plate is adjustable on the housing at different axial spacings from the top of the grinding body. It is especially advantageous here if the covering or plate can be firmly clamped at a variable axial spacing from the grinding body by preferably three, radially outward-protruding bearing arms distributed uniformly on the outer circumference, in graduated bearing faces, which are distributed uniformly, likewise at the spacing of the bearing arms, on the upper edge of the housing, by means of a securing ring that fits over the bearing arms.

The bearing arms, like the graduated bearing and supporting faces, are distributed on the housing relative to the housing circumference preferably at angular intervals of 120° each. The securing ring can be capable of being firmly clamped on the housing by means of helical threads, bayonet mounts, or by being clamped on.

In an especially advantageous modified embodiment, it is provided that the axial spacing between the grinding body and the covering or plate is variable by means of a set screw located centrally in a threaded bore on the covering in an extension of the drive shaft.

An especially stable embodiment of the grinding body with low weight can be furthermore attained in all the embodiments by providing that the grinding body is embodied as a hollow body of rotation that is open at the bottom and is angled on its outer circumference in the direction of the drive shaft; the grinding body is angled on its outer circumference at an angle of approximately 45° to 90°, or may have an outer circumference that is arched in curved form.

Preferred exemplary embodiments of the invention are shown schematically in the drawing.

FIG. 4 is an enlarged partial view of an additional fingernail template, with a ramp that can be secured with tabs in corresponding receptacles between adjacent slots on the upper covering or plate;

FIG. 5 shows a top view on the fingernail template of FIG. 4;

FIG. 6 shows two further embodiments of fingernail templates, which can be secured to adjacent slots on the upper covering or plate with a contact adhesive;

FIG. 7 is a front view of one such fingernail template, viewed from the direction of the arrows VII-VII in FIG. 6;

FIG. 8 shows by comparison a simplified fingernail template secured by contact adhesive, viewed in the direction of the arrows VIII-VIII in FIG. 6;

FIG. 9 is a vertical section through the fingernail template taken along the line IX-IX in FIG. 7;

FIG. 10 is a top view on the housing of a further modified embodiment of the nailcare device, in which the covering or plate with the slots can be adjusted in height relative to the rotating filing disk;

FIG. 11 is a top view on the covering or plate, with radially outward-oriented bearing arms;

FIG. 12 is a top view on a securing ring, with which the covering or plate can be secured to the housing of the device at different heights;

FIG. 13 is a section through the securing ring taken along the line XIII-XIII in FIG. 12;

FIG. 14 is a fragmentary side view of the covering or plate with an outward-protruding bearing arm in the direction of the arrow XIV in FIG. 11;

FIG. 15 is a fragmentary section through the housing of the device taken along the line XV-XV in FIG. 10;

FIG. 16 is a fragmentary side view of the housing with graduated rests for the bearing arms of the covering or plate of FIG. 11;

FIG. 17 is a side view, corresponding to FIG. 16, of the upper housing edge with bearing arms of the covering or plate of FIG. 11 firmly clamped at different heights by means of the securing ring of FIG. 12;

Figures 20, 21, 22, 23:
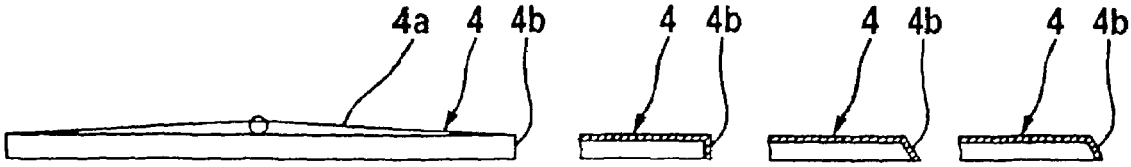
FIG. 20 shows a conical grinding body in a side view.

FIGS. 21 through 23 each show fragmentary sections through grinding bodies with differently shaped peripheral edges.

The housing 1 of the nailcare device is closed off at the bottom by a bottom 2. This bottom can be joined detachably or solidly to the housing 1, but this does not matter for the function of the device. It may be embodied with a slip-proof rubber or plastic base 2*a*, or as a suction cup as in FIG. 19.

The upper termination of the housing is formed by a covering 3, which is detachably joined to the housing 1 in a conventional way, for instance by means of a bayonet mount or a screw closure. Disposable batteries or rechargeable batteries are accommodated in or on the housing 1, as is an electric motor 6, which is supported on a compression spring 5 and is guided displaceably in a motor mount 7 relative to a motor support 8. Also located on the housing 1 are ON-OFF switch 11 required for the actuation and a connection outlet 12 for a charger that can be plugged in.

Figure 3:
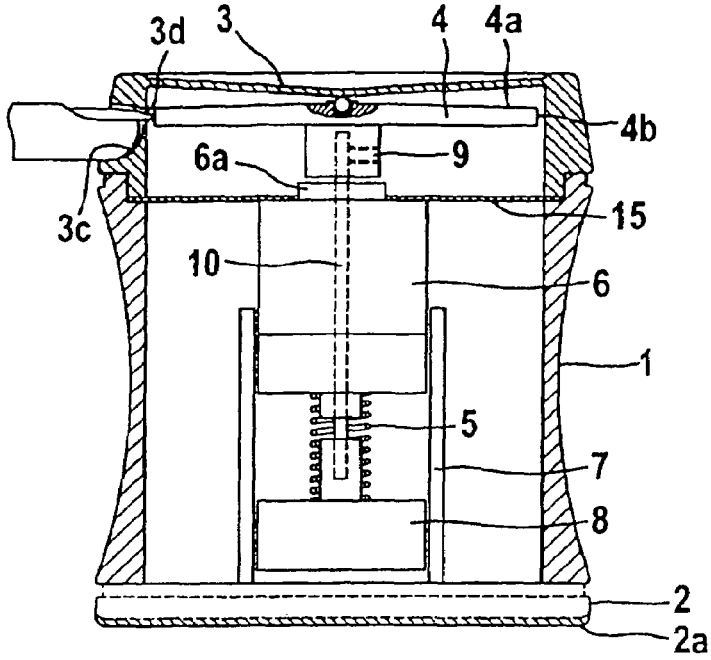
FIG. 3 is a vertical section through the device taken along the line III-III in FIG. 2.
Figure 1:
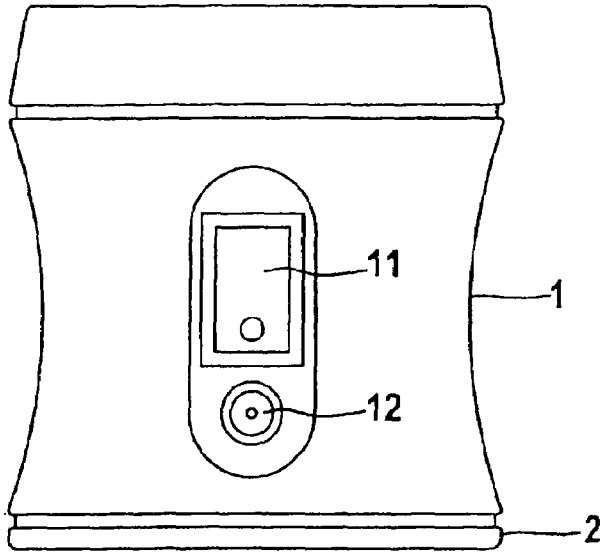
FIG. 1 shows a nailcare device in side view.

A grinding body 4 in the form of a filing disk is detachably mounted on the upper end of the drive shaft 10 of the electric motor 6 by means of a clamping element 9. In the covering or plate 3, which as shown in FIG. 3 can be dished in a slightly funnel-like fashion relative to the grinding body 4 or arched in slightly conical form as in FIG. 19, there are a number of slots 3*a*, so that the axial spacing between the top 4*a* of the grinding body 4 and the slots 3*a* located at different radii varies. In the exemplary embodiment shown in FIG. 2, three differently designed groups of three slots 3*a* each are shown. Depending on the size of the device, however, more or fewer groups, each with more or fewer slots 3*a*, may be present, for instance at angular intervals of approximately 90° or 120°. The slots 3*a* of one group differ in their slot width; the slots 3*a* of each group are offset radially from one another at different spacings relative to the slots 3*a* of the adjacent groups with respect to the axis of rotation of the grinding body 4, in such a way that when the fingernails are being filed in various slots, the grinding body 4 is occupied in each case along different circles on its surface.

Figure 2:
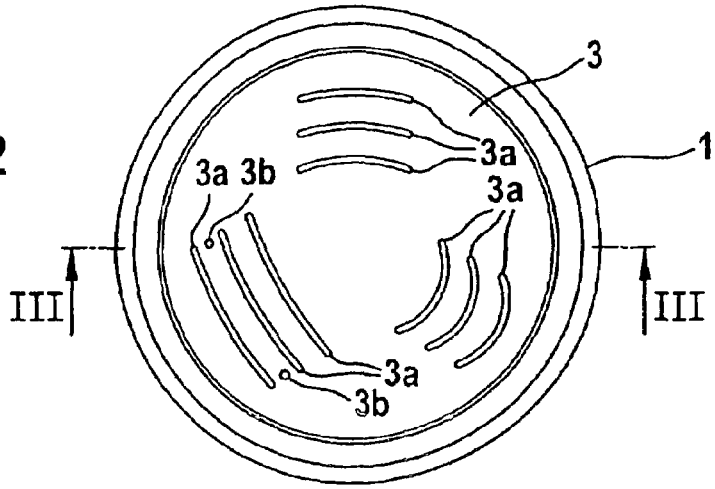
FIG. 2 shows a top view on the device.

The slots 3*a* may be assigned receptacles 3*b*, as shown in FIG. 2, onto which fingernail templates 13 can be slipped. Also in FIG. 3, a lateral dishlike rest 3*c* for a fingertip is located in the covering 3 and is just large enough to guide a finger with the fingernail to the lateral circumference 4*b* of the filing wheel 4, but with a slotlike opening for the fingernail toward the grinding body 4 that is so small that the fingertip cannot become injured as the fingernail is being filed.

Figure 18:
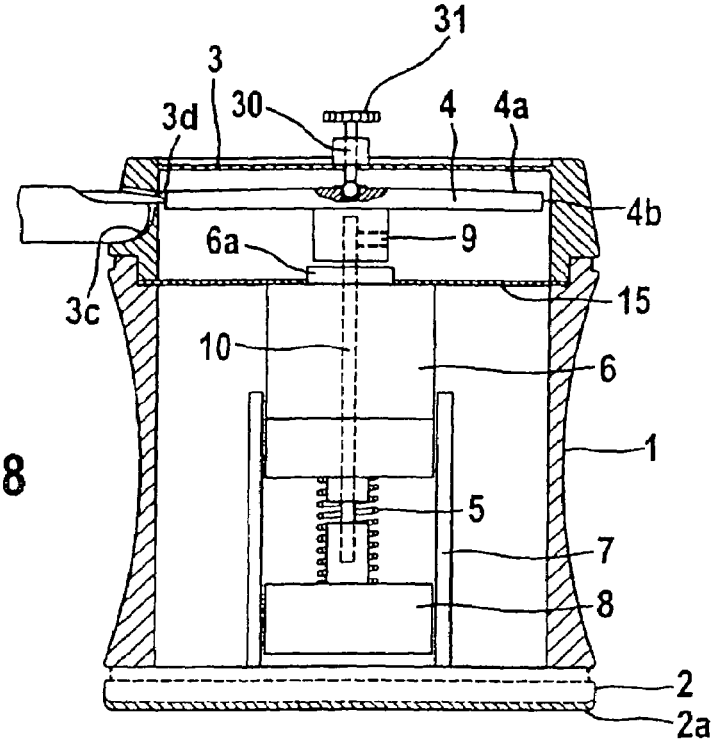
FIG. 18 is a section through a nailcare device with a set screw for varying the axial spacing between the cover plate and the grinding body.
Figure 19:
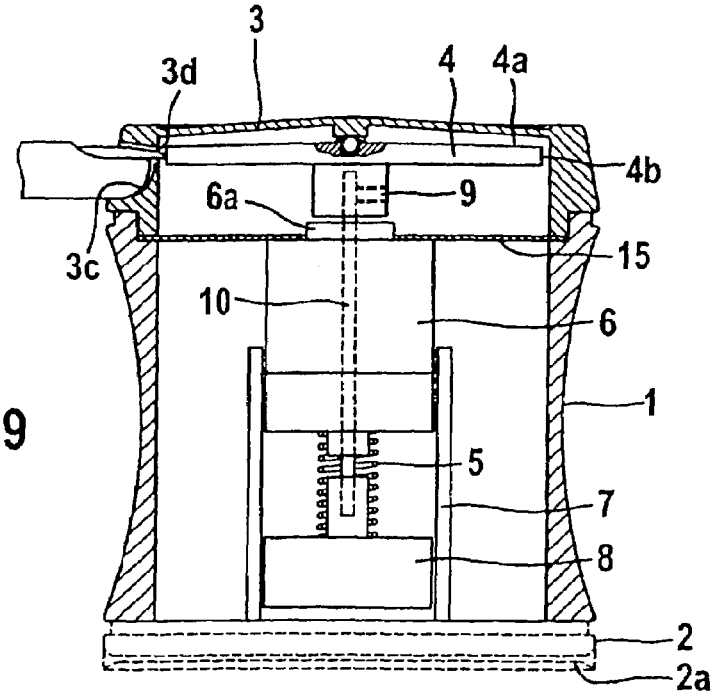
FIG. 19 is a section through a nailcare device with a slightly conically arched covering.

A dust guard sheet 15, as shown in FIG. 3 and FIGS. 18 and 19, is firmly clamped between the housing 1 and the covering 3 and surrounds, firmly closing it, the driving part 6*a* of the electric motor 6 between the drive shaft 10 and the side wall of the housing. The top 4*a* and the circumference 4*b* of the grinding body 4 are designed in the manner of a file. If switching on the electric motor 6 causes the grinding body or the filing wheel 4 to be set into rotary or oscillating motion, then a person can introduce one of her fingernails from above into a slot 3*a* that matches the shape and size of the fingernail, and as a result the fingernail comes into contact with the grinding body 4 on the top 4*a* thereof, and the fingernail is shortened thereby. Laterally rolling the finger to both sides of the slot 3*a* makes for uniform manicuring or shortening of the fingernail, and because the electric motor 6 is suitably supported resiliently, excessive filing down or even notching of the fingernail is avoided at the same time because the electric motor 6, with the filing wheel or grinding body 4, automatically deflects downward to escape excessive pressure of the fingernail from above, counter to the pressure of the compression spring 5.

The selectively provided dishlike rest 3*c* for the fingertip on the lateral edge of the covering or plate 3 is on the one hand so small that unwanted contact of the filing face with the outer circumference 4*b* of the filing wheel 4 is prevented, yet on the other hand is large enough that the fingernail can protrude through the slot 3*d* on the upper edge of the rest 3*c* and thus be manicured further by the filing face on the circumference 4*b* of the filing wheel 4.

By means of the receptacles 3*b* that can be associated with the individual slots 3*a* in FIG. 2, it is possible as shown in FIGS. 4 and 5, as needed, to install small, specially shaped ramps as fingernail templates 13, 13*a*, on which the fingertip can be rolled, on the slots 3*a* in order to lend the fingernails a special shape corresponding to the course of the ramps. This can be done for instance by inserting the fingernail templates 13 of FIGS. 4 and 5, with downward-pointing tabs 14, 14*a*, into the receptacles 3*b* and fixing them, in order to roll the finger with the fingertip along the ramp and lend the fingernail a suitable shape. The ramps may be replaced, installed, and removed again as desired.

In the two modified embodiments of FIGS. 6 through 9, the fingernail templates 13*a* shown there can also be detachably secured to the covering or plate by means of a contact adhesive. For that purpose, at least some of the slots 3*a* on the covering or plate 3 may have a radial width such that fingernail templates 13*a*, adapted to the course of the slot, with a rib 16 peripherally engaging the slot and with a profiled ramp 17 pointing upward from the rib 16, come into contact with a self-adhesive securing strip 18, parallel to the top of the plate 3 and oriented toward the rear, directly beside the slot 3*a*.

A further particular advantage of the removable covering 3 and of the dust guard sheet 15 is simple, fast cleaning of the device, by detaching the covering 3 from the housing 1 and removing the abraded material that has accumulated on the dust guard sheet 15 and then putting the covering 3 back on the housing 1.

In the further-refined embodiment of the nailcare device of FIGS. 10 through 17, the covering or plate 3 is adjustable on the housing 1 at various axial spacings from the top of the grinding body 4. For that purpose, the covering or plate 3, which in the above embodiments is embodied in one piece, is subdivided into a securing ring 20 and a loose plate 21. The housing 1 is also slightly modified; the outer circumference of the housing, as shown in section in FIGS. 10 and 15, is graduated toward the inside on the upper housing edge 22 and is provided with a thread 23 for the securing ring 20. Moreover, the face end of the housing 1 is provided with bearing faces, graduated relative to one another and located in a star pattern at an angular spacing of 120° each, for instance, for the radially outward-oriented bearing arms 25 of the loose covering or plate 21. At least three bearing faces 24*a*, 24*b*, 24*c* each, graduated relative to one another, belong together.

As can be seen in detail in FIGS. 16 and 17, the bearing faces 24*a*, 24*b*, 24*c* may be graduated on the housing edge 22, beginning at an assumed thickness of the material of the covering or plate 3 of 1 mm, for instance, by approximately 0.3 mm each in the direction of the housing axis. Accordingly, the first bearing face 24*a* may have a depth of 0.3 mm, for instance, the second bearing face 24*b* may have an indentation of 0.6 mm, and the third bearing face 24*c* may have an indentation of 0.9 mm relative to the upper housing edge.

The covering or plate 21 shown in FIG. 11, like the covering or plate 3 in the first embodiment, is equipped with slots 3*a*, which can be located, dimensioned and designed differently from one another. The covering or plate 21 furthermore has at least three bearing arms 25, which are arranged in a star pattern, each at equal angular intervals to the bearing faces 24*a*, 24*b*, 24*c* on the housing 1.

However, the three bearing arms 25 have a thickness such that they can be fixed on the upper housing edge at any desired height by means of the securing ring 20.

Depending on the desired length of the fingernail, the covering or plate 21 is placed in either the upper, the middle, or the lower indentations and firmly clamped in place with the securing ring 20. As a result, the spacing from the grinding body and thus the nail length attainable with the nailcare device, changes. The securing ring 20 is firmly clamped to the upper end of the housing by a female thread 26.

In the drawing, the fingernail template 13, 13*a* and the spacings of the graduated bearing faces 24*a*, 24*b*, 24*c* for the bearing arms 25 on the loose covering or plate 21 are shown greatly exaggerated, to make the principle of the invention clear. In practice, these details will be kept substantially smaller, as has also been noted in the description.

In the embodiment shown in FIG. 18, the axial spacing between the grinding body 4 and the covering or plate 3 is variable by means of a set screw 31 located centrally in the extension of the drive shaft 10 in a threaded bore 30 on the covering 3. This kind of change of spacing can also be attained in FIG. 20 by providing that the grinding body 4 is embodied slightly conically.

In all the embodiments of the grinding body 4 shown, especially good stability with low weight can furthermore be realized by providing that the grinding body 4 is embodied as a hollow body of rotation open at the bottom and angled on its outer circumference in the direction of the drive shaft 10. As shown in FIG. 21 or FIG. 22, it can be angled at an angle of approximately 45° to 90° on its outer circumference 4*b*, or as in FIG. 23 it may have an outer circumference 4*b* that is arched in curved form.

All the details shown taking individual nailcare devices as examples are understood to be advantageously usable in still other embodiments of the devices as well.

LIST OF REFERENCE NUMERALS

1 Housing
2 Bottom
2*a* Base
3 Covering, plate
3*a* Slots
3*b* Receptacles
3*c* Dishlike rest
3*d* Slot
4 Grinding body, filing wheel
4*a* Top
4*b* Circumference
5 Compression spring
6 Electric motor
6*a* Driving part of the electric motor
7 Motor mount
8 Motor support
9 Clamping element
10 Drive shaft
11 ON-OFF switch
12 Connection outlet for a charger
13 Fingernail template
13*a* Fingernail template
14 Tab
14*a* Tab
15 Dust guard sheet
16 Rib
17 Ramp
18 Securing strip
20 Securing ring
21 Loose covering or plate
22 Upper housing
23 Thread
24*a* Bearing face
24*b* Bearing face
24*c* Bearing face
25 Bearing arms
26 Female thread
30 Threaded bore
31 Set screw

The invention claimed is:

1. A nailcare device having a housing (1) and an electric motor-driven grinding body (4), which is seated on a drive shaft (10) connected to an electric motor (6) and is located in the upper part of the housing (1) under a covering (3, 21), which covering is attached, firmly seated but readily releasably, to the housing (1) of the device and has at least two slots (3*a*), at different radial spacings from the drive shaft (10), located as close as possible to the grinding body (4), for receiving the fingernail of the user, characterized in that the grinding body (4) is embodied as essentially discoid; and that the covering (3, 21), above the grinding body (4), is shaped such that the axial spacing between the top (4*a*) of the discoid grinding body (4) and the slots (3*a*), located on the covering (3, 21) at different radial spacings from the drive shaft (10), increases or decreases with increasing spacing from the drive shaft (10).

2. The nailcare device in accordance with claim 1, characterized in that the covering (3, 21) is dished in a slightly funnel-like fashion.

3. The nailcare device in accordance with claim 1, characterized in that the covering (3, 21) is slightly conically arched.

4. The nailcare device in accordance with claim 1, characterized in that the grinding body (4) is shaped slightly conically.

5. The nailcare device in accordance with claim 1, characterized in that for nailcare, the device can be placed on a level surface and does not need to be guided or held with the other hand.

6. The nailcare device in accordance with claim 5, characterized in that the bottom (2) of the device is embodied with a slip-proof base (2a) of rubber or plastic.

7. The nailcare device in accordance with claim 5, characterized in that the base (2*a*) of the device is embodied as a suction cup.

8. The nailcare device in accordance with claim 1, characterized in that the slots (3*a*) are of different shape, width, and/or length.

9. The nailcare device in accordance with claim 1, characterized in that a plurality of slots (3*a*), preferably in groups of two to four slots each, of the same and/or partly different shape, width, and/or length are located on the covering or plate (3, 21) at mutually offset radial spacings from the drive shaft (10), side by side above the grinding body (4).

10. The nailcare device in accordance with claim 1, characterized in that a plurality of slots (3*a*) of the same and/or partly different shape, width, and/or length are located in groups of two to four, preferably three, slots (3*a*), parallel or arched in curved form, each at equal radial spacings from one another.

11. The nailcare device in accordance with claim 1, characterized in that the individual groups of slots (3*a*) are distributed, each in approximately equal angular spacings of preferably approximately 90° or 120°, over the surface of the covering or plate (3, 21).

12. The nailcare device in accordance with claim 1, characterized in that the grinding body (4) is secured releasably and interchangeably to the drive shaft (10).

13. The nailcare device in accordance with claim 1, characterized in that the grinding body (4) is spring-loaded relative to the housing body (1) and the covering or plate (3, 21), preferably in the direction of the drive shaft (10), in such a way that it can escape an excessively strong nail pressure.

14. The nailcare device in accordance with claim 1, characterized in that at least one additional nail manicuring option exists on the lateral circumference of the device, next to the grinding body (4), with a rest (3*c*) for the fingertip and with a slot (3*d*), parallel to the grinding body (4), for the fingernail.

15. The nailcare device in accordance with claim 1, characterized in that the electric motor (6) is encapsulated against penetrating fingernail dust by a dust guard sheet (15) between the drive shaft (10) and the side wall of the housing.

16. The nailcare device in accordance with claim 1, characterized in that the slots (3*a*) on the covering or plate (3, 21) can be assigned fingernail templates (13, 13*a*), in the form of interchangeable, differently shaped ramps for the fingertip to roll on, for special shapes of nails.

17. The nailcare device in accordance with claim 16, characterized in that the fingernail templates (13) can be attached in slip-proof fashion to the covering or plate (3, 21), preferably by terminal tabs (14, 14*a*), in receptacles (3*b*) between slots (3*a*) located side by side.

18. The nailcare device in accordance with claim 16, characterized in that the fingernail template (13*a*) can be secured releasably to the covering or plate (3, 21) by means of a contact adhesive.

19. The nailcare device in accordance with claim 16, characterized in that at least some of the slots (3*a*) on the covering or plate (3, 21) have a radial width such that by means of a rib (16) peripherally engaging the slot, and by means of a profiled ramp (17) oriented upward from the rib (16), fingernail templates (13*a*) adapted to the course of the slot come into contact with a self-adhesive securing strip (18), parallel to the top of the plate (3, 21) and oriented to the rear, directly beside the slot (3*a*).

20. The nailcare device, in particular in accordance with claim 1, characterized in that the covering or plate (3, 21) is adjustable on the housing (1) at different axial spacings from the top of the grinding body (4).

21. The nailcare device in accordance with claim 20, characterized in that the covering or plate (3, 21) can be firmly clamped at a variable axial spacing from the grinding body (4) by preferably three, radially outward-protruding bearing arms (25) distributed uniformly on the outer circumference, in graduated bearing faces (24*a*, 24*b*, 24*c*), which are distributed uniformly, likewise at the spacing of the bearing arms (25), on the upper edge (22) of the housing (1), by means of a securing ring (20) that fits over the bearing arms (25).

22. The nailcare device in accordance with claim 20, characterized in that the bearing arms (25), like the graduated bearing and supporting faces (24*a*, 24*b*, 24*c*), are distributed on the housing relative to the housing circumference, preferably at angular intervals of 120° each.

23. The nailcare device in accordance with claim 20, characterized in that the securing ring (20) can be firmly clamped on the housing (1) by means of helical threads (24, 26), bayonet mounts, or by being clamped on.

24. The nailcare device in accordance with claim 1, characterized in that the axial spacing between the grinding body (4) and the covering or plate (3) is variable by means of a set screw (31) located centrally in a threaded bore (30) on the covering in an extension of the drive shaft (10).

25. The nailcare device in accordance with claim 1, characterized in that the grinding body (4) is embodied as a hollow body of rotation that is open at the bottom and is angled on its outer circumference in the direction of the drive shaft (10).

26. The nailcare device in accordance with claim 25, characterized in that the grinding body (4) is angled on its outer circumference (4*b*) at an angle of approximately 45° to 90°.

27. The nailcare device in accordance with claim 1, characterized in that the grinding body (4) has an outer circumference (4*b*) that is arched in curved form.

* * * * *